United States Patent [19]

Rubin et al.

[11] Patent Number: 4,691,203

[45] Date of Patent: Sep. 1, 1987

[54] DOWNHOLE TELEMETRY APPARATUS AND METHOD

[76] Inventors: Llewellyn A. Rubin, 3295 S. Allegheny Ct., Westlake Village, Calif. 91359; William H. Harrison, 7280 Hyannis Dr., Canoga Park, Calif. 91306

[21] Appl. No.: 510,298

[22] Filed: Jul. 1, 1983

[51] Int. Cl.[4] ..... G01V 1/40

[52] U.S. Cl. ..... 340/856; 367/81; 324/369; 340/854

[58] Field of Search ..... 340/853, 854, 861, 856; 367/81, 82; 175/40, 50; 455/20; 324/356, 369, 373

[56] References Cited

U.S. PATENT DOCUMENTS

| | | | |
|---|---|---|---|
| 2,379,800 | 7/1945 | Hare | 340/854 |
| 3,906,435 | 9/1973 | Lamel et al. | 367/81 |
| 3,945,704 | 3/1976 | Kraus et al. | 340/665 |
| 4,087,781 | 5/1978 | Grossi et al. | 340/854 |
| 4,348,672 | 9/1982 | Givler | 340/854 |
| 4,496,174 | 1/1985 | McDonald et al. | 324/356 |

FOREIGN PATENT DOCUMENTS

| | | | |
|---|---|---|---|
| 911411 | 3/1982 | U.S.S.R. | 367/81 |

OTHER PUBLICATIONS

McDonald et al., "Borehole Telemetry System . . . " Oil and Gas Journal, 9/15/75, pp. 111-118.

*Primary Examiner*—Salvatore Cangialosi
*Assistant Examiner*—Ian J. Lobo
*Attorney, Agent, or Firm*—Koppel & Harris

[57] ABSTRACT

A system and method is described for amplifying and transmitting an information signal from a downhole drillstring location. The amplifier shifts the relatively low frequency information signal up to a high frequency level, amplifies the high frequency signal and processes it through an impedance matching transformer, and then demodulates the amplified signal back to the original low frequency for transmission through the earth to the surface, thus enabling the use of a much smaller transformer than when the information signal is processed entirely at the low frequency level. A novel transducer consisting of generally cylindrical conductive sleeves separated by an insulative gap is used to provide structural integrity and to transmit the amplified information signal. The conductive sleeves are heat shrunk onto an insulative sleeve and a central mandrel.

35 Claims, 9 Drawing Figures

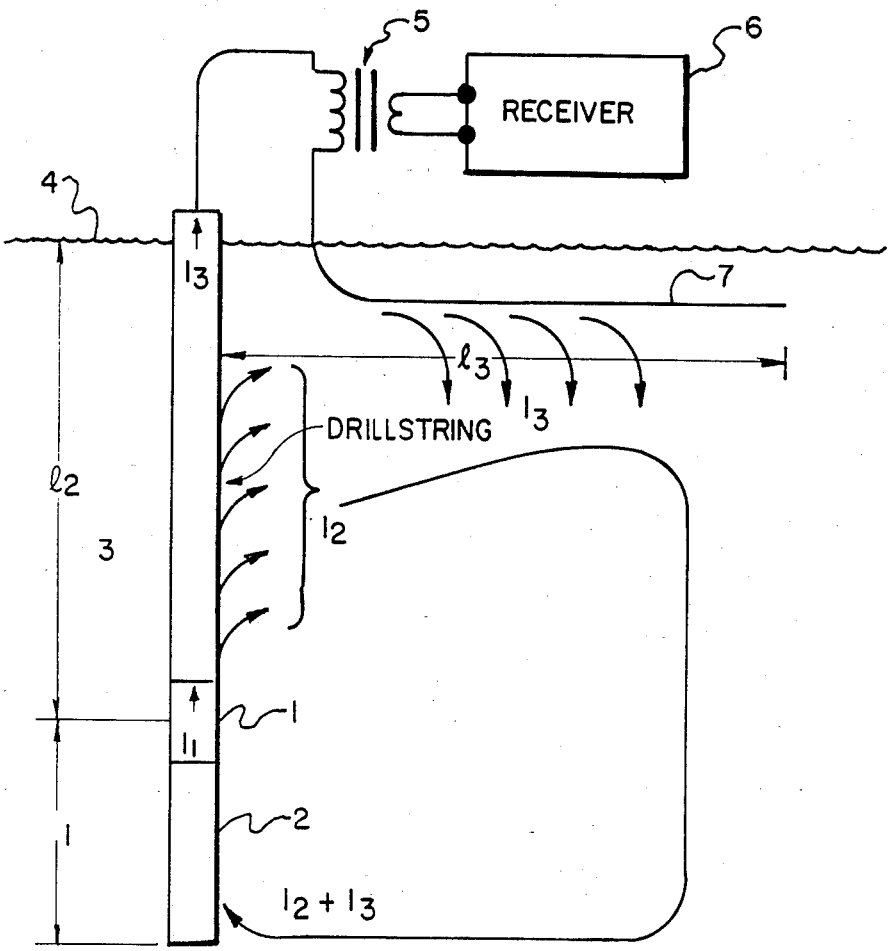
FIG. 1.A.
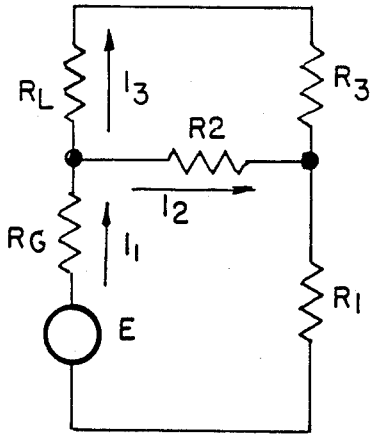
FIG. 1.B.

DOWNHOLE TELEMETRY APPARATUS AND METHOD

BACKGROUND OF THE INVENTION

1. Field of the Invention

This invention relates to the transmission of information signals from a borehole location, and more particularly to a novel amplifier and drillstring transducer for transmitting low-frequency-electromagnetic information signals as part of a drillstring/ earth telemetry (D-S/ET) measurement-while-drilling (MWD) operation.

2. Description of the Prior Art

Modern drilling techniques for oil wells and the like require near-real-time transmission from the downhole location near the end of the drillstring up to the surface. Various sensory devices are provided in the drillstring so that information on downhole temperature, the drilling medium, drillstring orientation, etc. can be measured and transmitted to the surface. In order to optimally control the drilling process and achieve economic drilling of an oil well or the like, this information should be provided while the drilling is going on, a mode referred to as measurement-while-drilling (MWD).

The essential element in borehole electromagnetic telemetry is the wave-propagation means between the downhole and uphole terminals, including special provisions for coupling the signals into and out of the propagation medium at both ends with mode couplers, consistent with the specific electromagnetic and geometric contraints at each terminal. One particular electromagnetic propagation method is sometimes referred to as the drill-string/earth telemetry (D-S/ET) mode, in that in some ways it behaves like a two-wire transmission line. In this mode, the drillstring is one conductor and the earth's bulk conductivity is the other. The loss mechanisms include (a) transducer losses at each terminal, (b) mismatch losses at each terminal, (c) series ($I^2R$) losses associated with the "conductors", and (d) shunt ($V^2G$) losses associated withthe shunt-path conductivity between the "conductors".

In general, in D-S/ET the propagation path is principally characterized by increasing attenuation (loss of signal) with increasing distance (depth), increasing data rate, and increasing conductivity of the earth's bulk. Provided that a carrier frequency is used which provides skin depths much greater than drillstring diameters, then factors such as drillstring diameter, wall thickness, material, and joints become second-order along with the electrical characteristics of the drill fluid so long as the formation is reasonably tight and/or under positive pressure.

In order to transmit an information signal by the D-S/ET method up through the earth from a downhole location, one or more electrical discontinuities must exist in the drillstring at the point from which the information is to be transmitted. Two methods that have been used for D-S/ET transmission are direct coupling and toroidal coupling. The direct coupling method requires a complete electrical discontinuity in the drillstring so that a potential difference can be produced across adjacent conducting faces of the drillstring. The toroidal coupling technique, which is more conventional, requires an electrical discontinuity only in the outer portion or sheath of the drillstring, to prevent the existence of an unwanted short-circuited turn.

The conventional way of implementing the toroidal coupling technique has been to configure the drillstring transducer apparatus as a slender toroidal transformer with a mandrel of conducting, strengthening members running through the center of the toroidal core, the mandrel serving as both the principal structural element and as one-half of a one-turn secondary winding. The toroidal transformer provides impedance matching between the low frequency information signals, which may be less than 10 Hertz, and the very-low-impedance earth-load through which they are transmitted, which may be as low as 50 millohm. In the case of a direct coupled system, in which a complete electrical discontinuity is provided in the drillstring, a separate multi-turn secondary transformer may be used with or without an electrically-conducting mandrel.

Because of the relatively high degree of impedance matching required, the toroidal transformers used in the prior art have been quite long, typically extending for ten to thirty feet along the drillstring. A steel sheath has been used to protect the core and windings, the sheath providing structural bending strength but little significant tensional or torsional strength. The internal mandrel provides tensile and torsional strength, but less than that provided by the rest of the drillstring. The low frequency information signals required a large transformer core volume, the volume of the transformer being inversely proportional to the frequency raised to the 3/2 power.

After the sensor signals have been conditioned and their information modulated onto a carrier signal, the modulated signal has to be amplified before it can be transmitted. This has been done in the past by the use of conventional amplifiers operating at the carrier-signal frequencies. This combination of signals, conventional amplifiers and large impedance-matching transformers exhibit a number of inherent disadvantages. The equipment is large and expensive to build, and is fairly low in strength because the shape must be accomodated to the narrow drillstring. The transformer is restricted to a single secondary turn, making it difficult to adjust the turns ratio when necessary to achieve efficient impedance matching. The power handling capability is restricted due to the limited amount of space for the magnetic core material. Additionally, the mandrel restricts the flow of drill fluid through the interior of the drillstring.

SUMMARY OF THE INVENTION

In view of these and other problems associated with the prior art, it is an object of the present invention to provide a D-S/ET apparatus and method for the efficient transmission of low frequency information signals which avoids the need for a long, narrow, and structurally inferior toroidal transformer, by employing a simple, strong structure.

Another object is the provision of a D-S/ET apparatus and method which exhibits lower power dissipation, is less expensive and is much easier to transport and handle on the drill rig because of smaller, shorter, lower weight drillstring elements, than prior art techniques.

Another object is the provision of a D-S/ET apparatus and method which permits easily adjusted impedance matching to be adapted to the particular application, thus resulting in maximum signal power transfer to the propagation path.

These and other objects are accomplished in the present invention by the provision of two specific novel items, namely: (1) an adaptive, wide impedance-range-matching power amplifier which, instead of merely amplifying the low frequency information signal as in the prior art, shifts that signal up to a much higher frequency, amplifies the high frequency signal, transforms the impedance level of the signal, and then reduces the frequency of the amplified signal down to the low frequency range for transmission through the earth. In this way a much smaller impedance matching transformer can be used than if the amplification was performed at the lower frequency, and one small transformer can easily be replaced by another for widely different impedance matching situations, and (2) a matched-feed-point (MFP) D-S/ET mode transducer which provides the needed total electrical discontinuity in the drillstring while acting in every other way as an operational section of drill collar. The amplified signal is launched by the simple but high strength MFP transducer structure consisting of a pair of generally cyclindrical and electrically conductive sleeves which form a section of the drillstring and are held in axial alignment with their adjacent ends separated from each other by a predetermined insulative gap. Insulation around the gap is selected to induce optimum earth currents when the amplified electrical signal is applied across the sleeves.

In a preferred embodiment of the power amplifier, the low frequency information signal is shifted to a high frequency by means of a pulse-width modulation circuit, and after amplification is shifted back to its original frequency by means of a demodulator circuit. The demodulator circuit includes a full-wave rectifier section and a logic circuit which reverses the polarity of the full-wave rectified signal after each half cycle of the low frequency signal, thereby reproducing the original information signal in an amplified form.

In a preferred embodiment of the MFP transducer, outer conductive sleeves are heat shrunk onto a central mandrel, the surface of which has previously been treated with an electrically insulative coating. One or both adjacent faces of the outer conductive sleeves are similarly pretreated with an electrically insulative coating. The output from the transmitter unit is then connected low side to the lower (downhole) conductive sleeve and high side to the central mandrel. When transmitting, the electrical signal appears across the two outer conductive sleeves.

The outer conductive sleeves are made of 17-PH-4 stainless steel, the central mandrels are made of 4140 steel, and the insulative coatings are made of hard-anodized aluminum alloy. This combination provides good final strength at reasonable pre-shrunk temperatures.

Other objects and features of the invention will be apparent to those skilled in the art from the following detailed description of a preferred embodiments, together with the accompanying drawings in which:

DESCRIPTION OF THE DRAWINGS

FIG. 1*a* is a simplfied elevation view of a drillstring/earth telemetry system employing the present invention;

FIG. 1*b* is a simplified equivalent circuit of the sysetm shown in FIG. 1*a;*

DETAILED DESCRIPTION OF A PREFERRED EMBODIMENT

Figure 2:
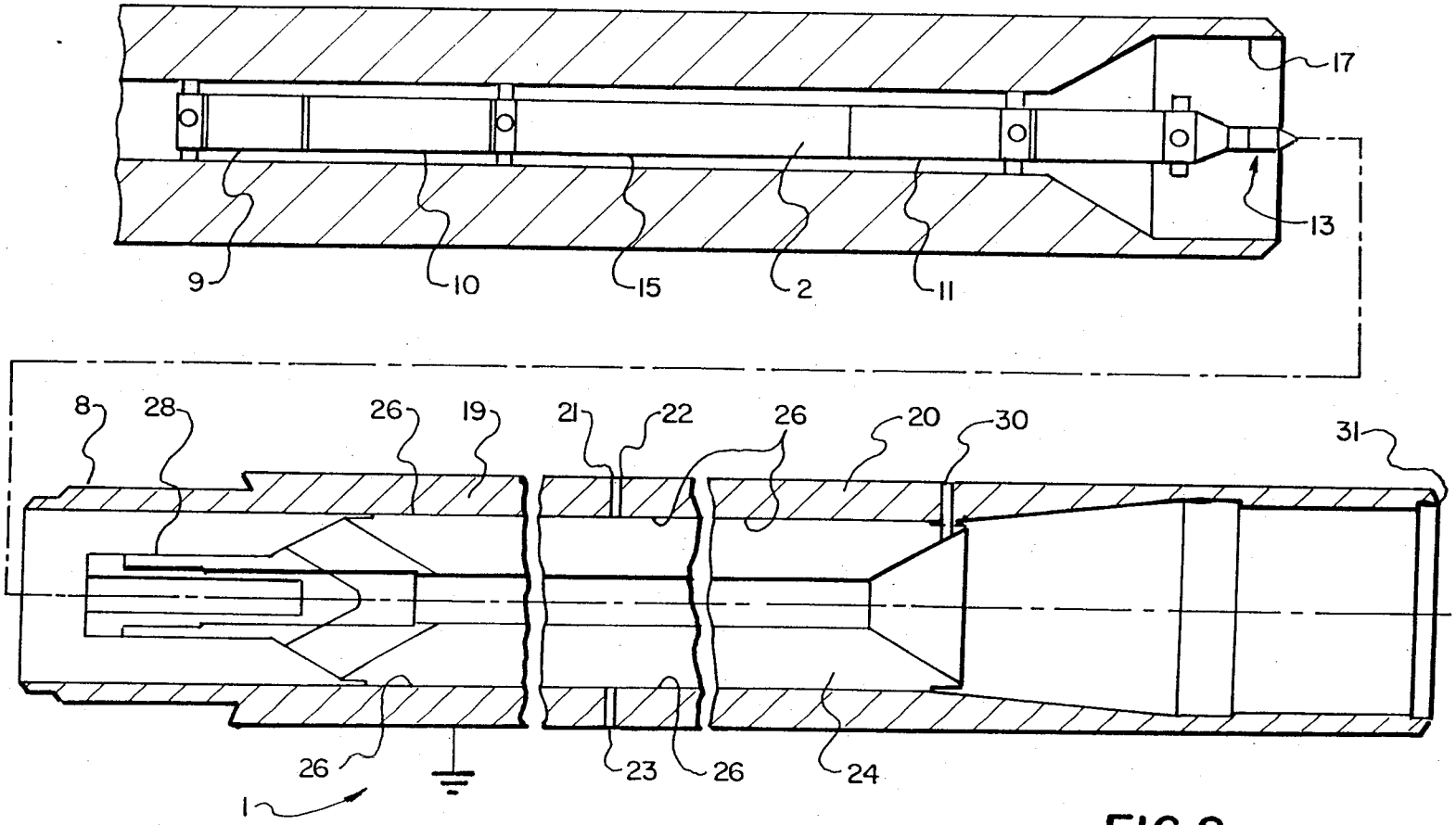
FIG. 2 is a two-part sectional view of a downhole power amplifier and MFP transducer constructed in accordance with the invention.

FIG. 1*a* depicts a typical drill-string/earth telemetry system employing the pressent invention. The downhole components of the D-S/ET system include an MFP mode transducer 1 and a downhole instrumentation unit 2 which is contained in the drill collar immediately below the mode transducer portion. This collar is part of the bottom hole assembly and is frequently a non-magnetic survey collar. The upper portion of the drillstring 3 conducts the current produced by the mode transducer 1 to the surface 4 where it is transferred from the drill pipe through a wire to an input transformer 5 for receiver 6. The current flows through the transformer primary and thence along wire 7 installed in the ground near the surface 4. The current from wire 7 propagates through the earth 8 back to the bottom-hole assembly 2 and finally completes its path into the mode transducer 1. The lengths of the bottom-hole assembly 2, upper drillstring 3, and surface cable 7 and $l_1$, $l_2$ and $l_3$, respectively. In the approximate equivalent circuit shown in FIG. 1*b*, the telementry transducer and transmitter are represented by E and $R_G$. $R_L$ represents the effective resistances of the bottom-hole assemply 2 and surface cable 7, respectively. $R_2$ represents the shunting effect manifested by a loss of some of the drillstring current $I_1$. This shunt current $I_2$ subtracts from $I_1$, leaving only a small fraction of the original current $I_1$ at the surface as $I_3$.

Referring now to FIG. 2, the downhole subsystem portion of a D-S/ET system is shown. The downhole instrumentation unit 2 includes a sensor section 9 which houses an array of sensors for detecting environmental conditions, drillstring orientation, etc. The sensor section produces low frequency signals which contain information on the parameters being measured. These signals modulate a carrier signal which is supplied to a conventional amplifier 10 which amplifies the power of the low frequency modulate carrier signals.

The amplified low frequency signals are then delivered either to a novel MFP power amplifier 11 which provides power gain and impedance matching between the input information signal and the input 28 of the MFP mode transducer 1 through probe 13, or if the MFP power amplifier is not needed to a matching transformer unit (MTU) 14 which simply provides impedance matching between the conventional amplifier 10 and the input of the MFP mode transducer 1. A battery pack 15 furnishes power to all the D-S/ET downhole units. The downhole instrumentation unit 2 is made to fit inside of a standard monel survey collar 16 which mates with the MFP mode transducer at joints 17, 18.

Referring now to the lower half of FIG. 2, a novel MFP transducer 1 is shown which permits the elimination of the toroidal transformers used in the prior art. The transducer design permits the use of easily interchangable transforemrs 14 thus permitting not only a choice of turns ratio but also a choice of the number of secondary turns, thereby allowing the transformer design to be optimized for the particular application. Since the transducer eliminates the toroidal transformer, greater mechanical strength may be achieved than in the prior art.

The transducer consist of a pair of cylindrical sleeves 19, 20 which are formed from a strong, electrically conductive material such as steel. The sleeves 19, 20 have equal diameters and are aligned on a common axis, with their adjacent ends 21, 22 separated by a gap which is filled with an insulating anodized aluminum washer 23. When a voltage is impressed across the sleeves on opposite sides of the gap, a current is produced which travels along the drillstring and through the earth to the surface.

The transducer includes an inner cylindrical metallic member or mandrel 24, the outer surface of which is separated from the inner surfaces of sleeves 19 and 20 by a thin insulating sleeve 26. Member 24 receives a signal from the MFP amplifier or MTU of the present invention, to be described hereinafter, via a bushing 28 which mates with probe 13. The signal is conducted through bushing 28 to outer sleeve 20 through a conductive pin 30 which electrically connects member 24 and sleeve 20. The MFP transducer is formed from simple geometrical parts which are constructed from compatable materials having a combination of structural and electrical characteristics. The parts are assembled using a heat shrink process to achieve an electrical discontinuity between the ends of conductive sleeves 19 and 20 while achieving superior structural integrity as compated to the prior art. In the preferred embodiment the outer conductive sleeves 19, 20 are made of 17-PH-4 stainless steel, the mandrel 24 is made of 4140 steel, and the insulating sleeve 26 is made of hard-anodized aluminum alloy. Mandrel 24 is first cooled and insulating sleeve 26 is heated to a suitable temperature so that the insulating sleeve can be slipped into place over the mandrel. After its parts have equalized in temperature, the insulating sleeve/mandrel assembly is cooled and the outer conductive sleeves 19, 20 and washer 22 heated to a suitable temperature so that the outer components can be slipped into place over the inner assembly. After equalizing in temperature, the resulting MFP transducer is strong enough to form an integral load-bearing section of the drillstring, with a simpler construction than prior art transducers.

In both versions (MFP amplifier or MTU) the impedance matching transformer can be much smaller than the toroidal transformers previously used. Since the transformers of the present invention have self-contained primary and secondary windings, rather than using the drillstring mandrel as a secondary winding, different transformers can be used for different impedance matching applications. One transformer can be easily substituted for another merely by replacing the MTU. In the case of the MFP amplifier, the particular high frequency transformer utilized is able to provide good power-transfer efficiency over a wide impedance range. Different transformers are used when moving from one drilling area to another.

Figure 3:
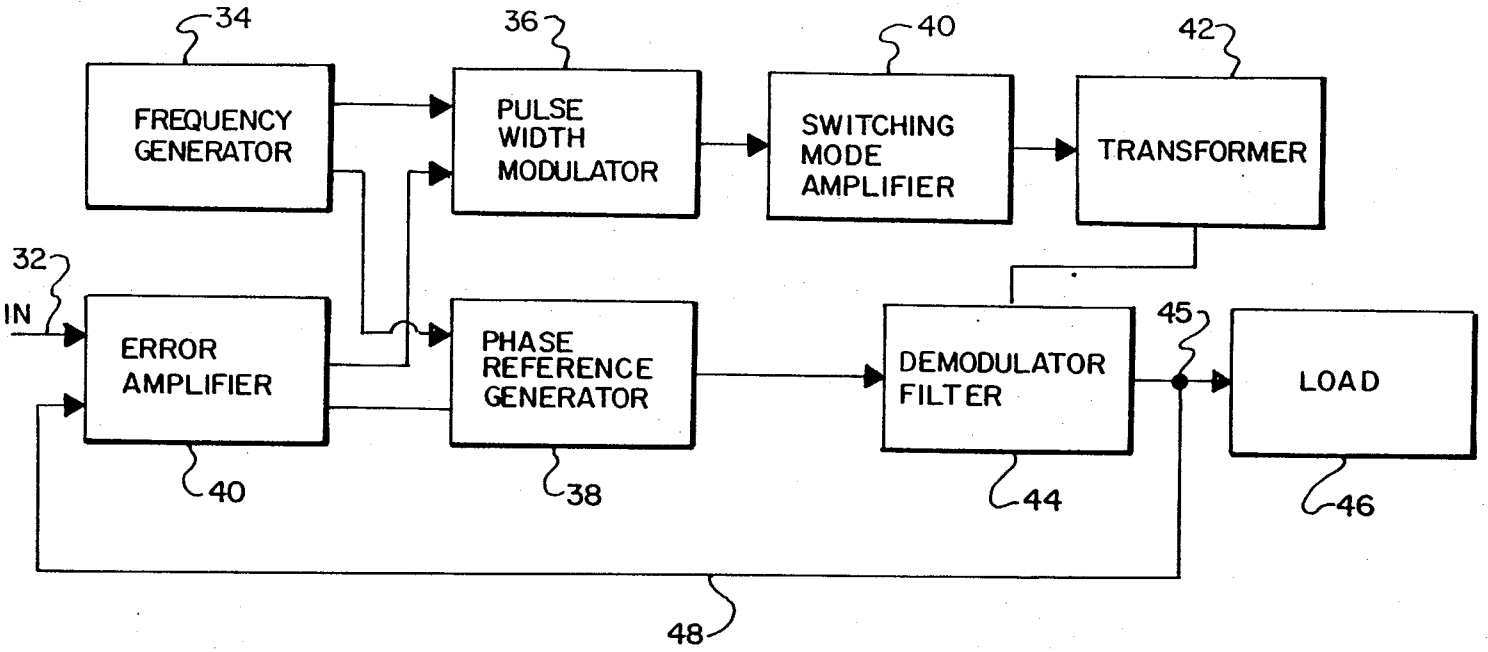
FIG. 3 is a block diagram of the amplifier section.

The novel power amplifier of the present invention is shown in block diagram form in FIG. 3. An input terminal 32 receives a low power, modulated low frequency information signal from the sensor section. The frequency of the information signals is typically in the order of 6 Hz, which ordinarily would require a very large transformer for impedance matching. The present invention totally eliminates the need for the large transformers employed in the prior art by first shifting the information signal up to a much higher frequency level, amplifying the signal at the high frequency level, processing the high frequency signal through an impedance matching transformer which can be much smaller than the transformer required at low frequencies, and then restoring the amplified signal back to its low frequency level for transmission from the drillstring.

In the preferred embodiment of the amplifier shown in FIG. 3, a frequency generator 34 generates a high frequency square wave signal in the order of 50 kHz, which is delivered to a pulse width modulator circuit 36 and a phase reference generator circuit 38. The input low frequency signal is processed through an error amplifier 40 where it is compared with output signal 45 and the difference is then delivered to pulse width modulator circuit 36, where it modulates the high frequency square wave signal so that the width of each square wave pulse represents the instantaneous amplitude of the low frequency signal. The low frequency input signal is also delivered through error amplifier 40 to the phase reference generator circuit 38, where it is combined with the high frequency signal from generator 34 to produce an output phase reference signal which alternates polarity after each half cycle of the low frequency input.

The high frequency, pulse modulated output of pulse width modulator circuit 36 is amplified by switching mode amplifier 40, the output of which is in turn processed through an impedance matching transformer 42. The output of transformer 42 is connected to a demodulator/filter circuit 44 which replicates the original input information signal in amplified form, the demodulator/filter circuit receiving an input from phase reference generator 38 to control the polarity of the demodulated signal. The output of demodulator/filter circuit 44 is connected to a load 46, which comprises the transducer and the earth path from the transducer to the surface. A feedback line 48 is connected between the output 45 of the demodulator/filter 44 an the input of error amplifier 40 to assure that the signal transmitted to the surface replicates the input information signal.

Figure 4:
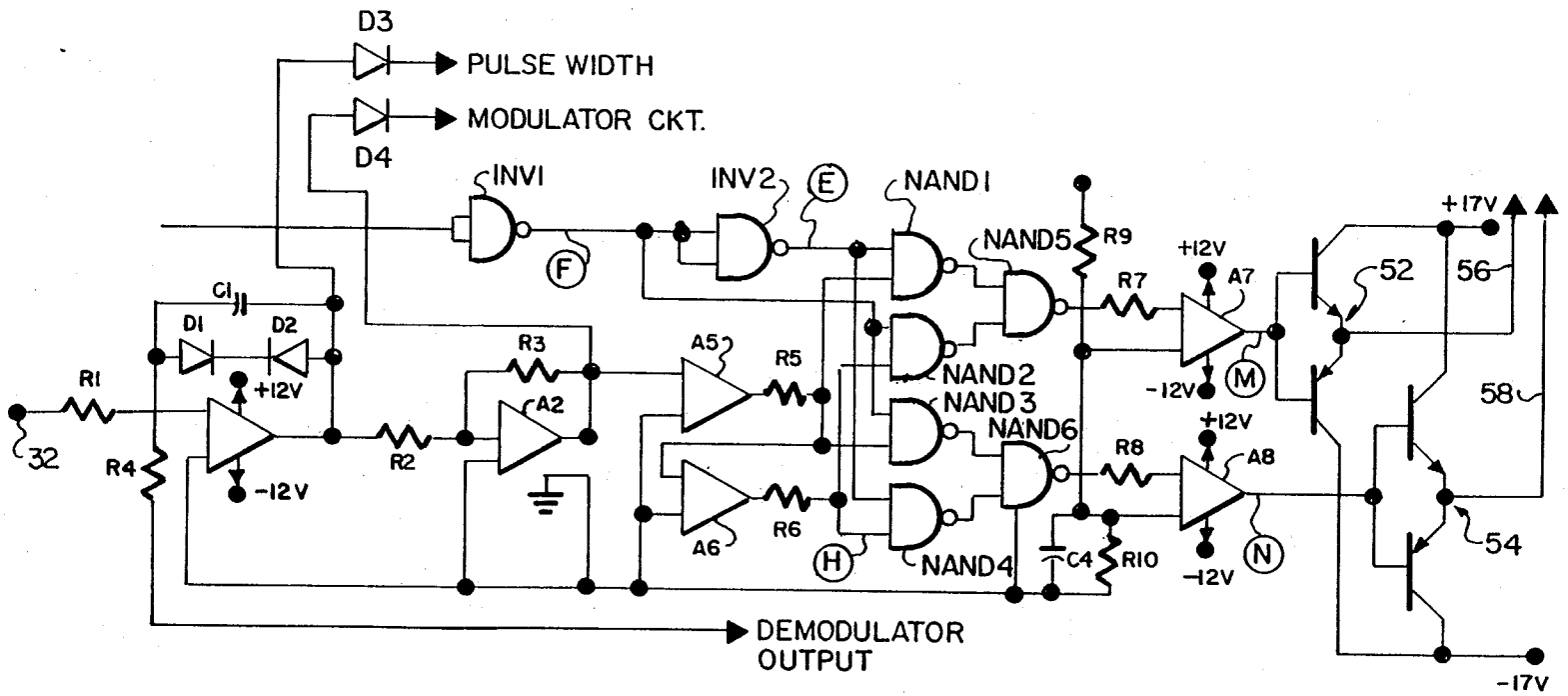
FIG. 4 is a schematic diagram of the input and logic sections of the amplifier.

The error amplifier and phase reference generator portions of the amplifier are shown in FIG. 4. The input terminal 32 is connected through a resistor R1 to the inverting input terminal of an operational amplifier A1, the non-inverting input of which is grounded. Opposed series connected zener diodes D1 and D2 are connected in parallel with capacitor C1 in a feedback circuit across amplifier A1. The output of A1 is connected through a resistor R2 to the inverting input of a second operational amplifier A2, the non-invertion input of which is also grounded, while a resistor R3 is connected across A2 to form a unity gain inverting amplifier. The outputs of amplifiers A1 and A2 are connected respectively through diodes D3 and D4 to the pulse width modulator circuit 36, details of which are given in FIG. 5. A feedback circuit is provided along line 48 and through a resistor R4 between the demodulator output and the inverting input to amplifier A1.

Frequency generator 34 shown in FIG. 5 generates a high frequency square wave of 50 kHz, which is converted within the generator to a DC offset triangular waveform as described hereinafter. This waveform is converted back to a 90 degree phase shifted 50 kHz square wave in the logic circuit shown in FIG. 4 by inverter INV 1, the output of which is again inverted by inverter INV 2. Also within the logic circuit, the output of amplifier A2 is connected to the inverting input of operational amplifier A5 which produces a ±12 volt low frequency square wave output of the opposite polarity. The output of A5 is applied through a resistor R5 to the inverting input of an operational amplifier A6, the latter amplifier having a resistor R6 connected at its output. The non-inverting inputs to A5 and A6 are both grounded. The outputs of high frequency inverters INV1 and INV2 and low frequency amplifiers A5 and A6 are applied to the inputs of a series of NAND gates NAND1-NAND4 is the following combinations:

NAND1: INV2 and A5
NAND2: INV1 and A6
NAND3: INV1 and A5
NAND4: INV2 and A6.

The outputs of NAND1-4 are each in the form of high frequency square waves for the positive half of each low frequency cycle, and constant positive logic signals for the other half of the low frequency cycle. The outputs of NAND1 and NAND2 are connected as inputs to another NAND gate NAND5, while the outputs of NAND3 and NAND4 are connected as inputs to a NAND gate NAND6. The outputs of these last two gates are connected respectively through resistors R7 and R8 to the inverting inputs of operational amplifiers A7 and A8. The non-inverting inputs of A7 and A8 are connected through resistor R9 to a 12 volt bus, and through an RC circuit R10, C4 to ground, this circuit functioning to bias A7 and A8 to a nominal +16 volts.

The outputs of amplifiers A7 and A8 are in turn processed through complimentary emitter powr booster circuits 52 and 54, which increase the current drive of the resultant logic signals. The outputs of power boosters 52 and 54 are 50 kHz square waves which are 180° out of phase with each other. These output are delivered over lines 56, 58 to demodulator/filter circuit 44 shown in FIG. 6.

Figure 5:
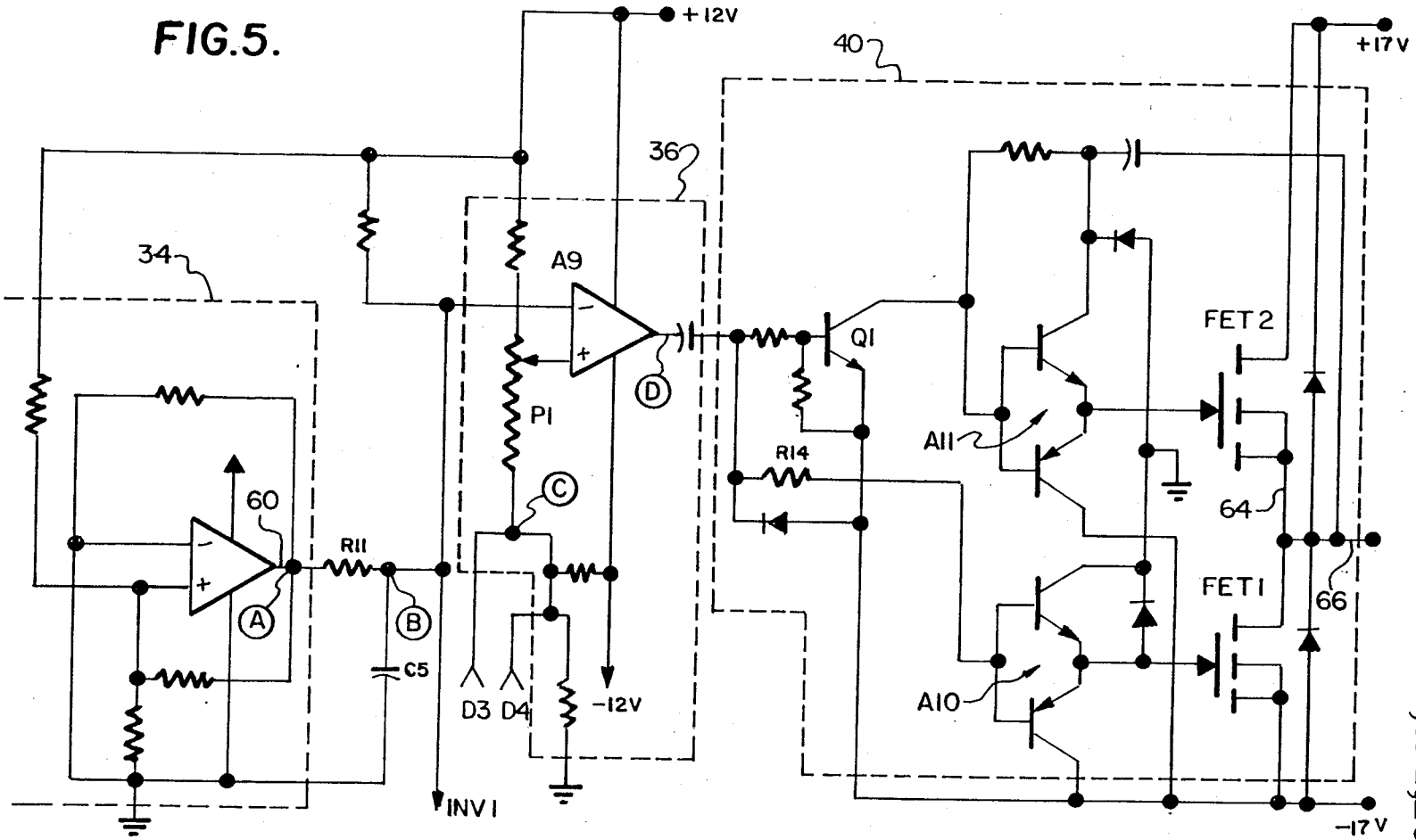
FIG. 5 is a schematic diagram of the upward frequency shift and amplifier sections of the amplifier.

FIG. 5 shows details of high frequency generator 34, pulse width modulator 36 and switching mode amplifier 40. The frequency generator is provided in the form of a conventional 50 kHz operational amplifier square wave generator 34, shown enclosed in dashed lines. The output of square wave generator 34 is applied through an RC circuit consisting of resistor R11 and capacitor C5, which produces an intermediate 50kHz signal at node 62 in the form of a triangular wave having an amplitude of about 4 volts peak-to-peak and also a positive DC offset of about 4 volts. This triangular waveform is applied to the inverting input of an operational amplifier A9 in the pulse width modulator circuit 36, which is also shown enclosed in dashed lines. The non-inverting input of A9 is connected to the adjustable tap of a potentiometer P1, which permits adjustment of the pulse width modulation applied to the high frequency signal.

The 180° out-of-phase half-wave rectified low frequency signals from diodes D3 and D4 in the error amplifier circuit 40 are applied to node C at one end of P1, resulting in a full-wave rectified low frequency signal at that point. The other side of P1 is connected through a resistor R12 to a positive voltage bus, while the side of P1 to which D3 and D4 are connected is tied to ground through a resistor R13. The resultant output of A9 is a pulse width modulated signal in which pulses appear at the high frequency rate, but with a width varying in accordance with the amplitude of the low frequency information signal appearing at node C.

The output of A9 is applied to switching mode amplifier 40, shown enclosed in dashed lines, which is preferably a conventional switching mode amplifier commonly referred to as a totem pole amplifier. The pulse width modulated signal is processed through an inverting amplifier transistor Q1, and also through a resistor R14. The pulse width modulated signal from R14 and the inverted pulse width modulated signal at the collector of Q1 are applied respectively to the inputs of complementary emitter power amplifiers A10 and A11. The power amplified, out-of-phase signals are then delivered respectively to enhancement mode field effect transistors FET1 and FET2, which function as high frequency switches, switching on when their respective gate voltages are positive with respect to their source and switching off when they are zero. The output drain of FET1 is connected to the output source of FET2 at node 64, resulting in a pulse width modulated signal which is delivered over line 66 and through capacitor C7 (shown in FIG. 6) to the transformer circuit shown in FIG. 6.

The power supply for the circuitry described thus far is provided from the unregulated +17 and −17 volt downhole subsystem batteries. However, a regulated source of voltage is desirable for the frequency generator 34, pulse width modulator 36, phase reference generator 38 and error amplifier 40 circuits. Since these circuits are relatively low power, positive and negative voltage regulators are used to convert the unregulated +17 and −17 volt battery voltage to regulated +12 and −12 volts for the circuits just mentioned. The remainder of the circuitry, including a portion of the phase reference generator 38 circuit, operates directly off of the unregulated 17 volt battery voltage. The input to switching mode amplifier 40 is a 12 volt signal, while its output is a 17 volt signal with a power much higher than that of the signal input, typically in the order of 1,000–10,000 times higher.

The circuitry shown in FIG. 5 utilizes a digital rather than analog operation. All devices are operated either saturated or OFF, resulting in a low power loss. This yields greater efficiency and a lower battery drain.

Figures 6, 7:
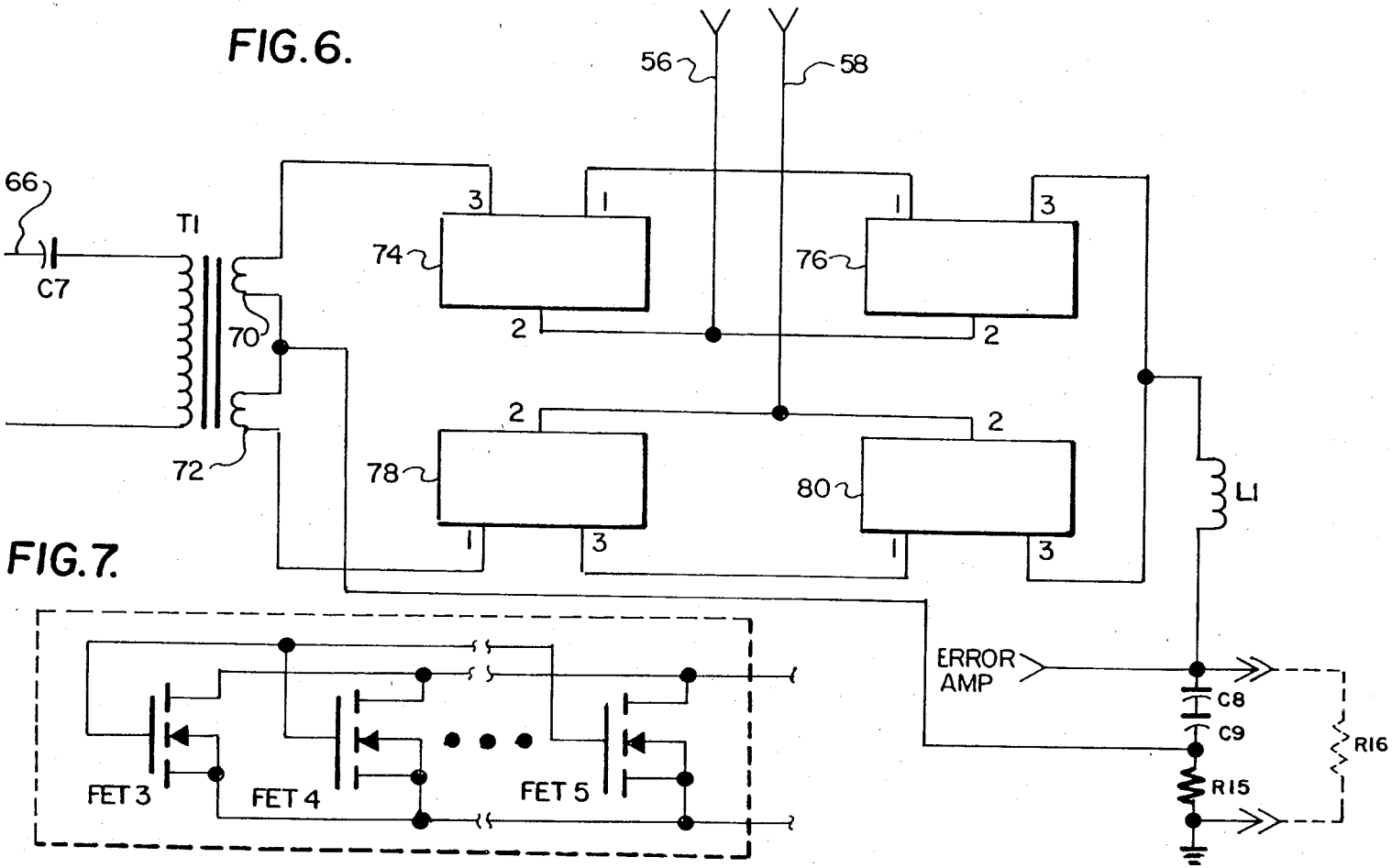
FIG. 6 is a schematic diagram of the transformer and downward frequency shift section of the amplifier.
FIG. 7 is a schematic diagram of a switching circuit employed in the downward frequency shift section of the amplifier.

The transformer 42, demodulator/filter 44 and load 46 circuits cited in FIG. 3 are shown detail in FIG. 6. The amplified and pulse width modulated signal on line 66 is applied through capacitor C7 to the primary winding of transformer T1. T1 has two secondary windings 70 and 72, connected in series aiding with their junction forming a center tap connected to a ground reference through a resistor R15. The oppsoite ends of secondary windings 70 and 72 are connected to a full wave bridge demodulator circuit comprising enhancement mode FET circuits 74, 76, 78 and 80. Each FET circuit is actually eight FETs connected in parallel, as shown in FIG. 7. The separate enchancement mode FETs FET3, FET4, FET5 shown in this figure each have a low on resistance of about 0.2 ohm, their combined resistances being reduced by the reciprocal of their number connected in parallel.

Referring back to FIG. 6, FET circuits 74 and 76 are connected in series with the end of transformer secondary winding 70, their gates being mutually connected to line 56 from the phase reference generator circuit. Similarly, FET circuits 78 and 80 are connected in series with the end of secondary winding 72, their gates being mutually connected to line 58 from the phase reference generator. The output drains of FET circuits 76 and 80 are connected together through a low pass filter comprising inductor L1 and capacitors C8 and C9 for transmission through the earth to the surface, the transducer and earth path being respesented by a low impedance load R16. The other end of this load is returned through the downhole end of the transducer, which is in intimate electrical contact with the chassis of the amplifier, and thence to the center tap of transformer T1 through resistor R15.

The transformer and FET circuits 74, 76, 78 and 80 act as a full-wave bridge rectifier to produce a signal at the terminals of output load R16 which is a replica of the original low frequency input information signal at input terminal 32, but impedance matched to the load and greatly amplified in power. This demodulation is performed in conjunction with the signals from phase reference generator 38.

The secondary transformer windings 70 and 72 carry pulse width modulated signals of opposite polarities with respect to the ground-referenced transformer center tap. Gating signals are provided to the gates of FET circuits 74, 76 and 78, 80 from the phase reference generator circuit over lines 56 and 58, respectively. With the voltage across secondary winding 70 positive and across secondary winding 72 negative, a gating signal is applied over line 56 to gate FET circuits 74 and 76 into conduction, while FET circuits 78 and 80 are left nonconductive. This results in a positive pulse from winding 70 being delivered to the low pass filter comprised of inductor L1 and capcitors C8, C9. The filter removes the high frequency components of the load current, thus supplying the earth load resistor R16 with a low frequency amplified signal version of the input signal at input terminal 32.

After one-half cycle of the high frequency signal, the polarity of the signals through secondary windings 70 and 72 reverses, and at the same time the gating signal on line 56 shifts to line 58. This causes FET circuits 78 and 80 to become conductive, so that the positive pulse width modulated signal on secondary winding 72 is applied through the filter (L1, C8, C9) to the earth load. The polarity of the signals carried by the secondary transformer windings and the gating signals on line 56 and 58 continue to alternate in synchronism at the high frequency rate, resulting in a positive low frequency signal which is applied to the earth load and which replicates the input low frequency information signal but is greatly amplified therefrom. After each half cycle of the low frequency signal the gating signal pattern on phase reference lines 56 and 58 shifts by one-half of the high frequency cycle, as described previously. As a result the polarity of the demodulated signal transmitted to the earth load reverses after each low frequency half-cycle, thus producing an output low frequency signal which replicates the entire input information signal in an amplified form. Since the frequency of the modulating signal is in the order of 8,000 times the frequency of the input information signal, assuming a 6 Hz input signal, the output amplified low frequency signal transmitted through the earth is relatively smooth; the smoothing effect is enchanced by filtering inductor L1 and capacitors C8 and C9.

The turns ratio of transformer T1 is selected to provide the necessary impedance matching between the input information signal and the earth load output for efficient power transfer through the amplifier circuitry. In the preferred embodiment depicted herein, in which a ±17 volt signal is applied to the primary transformer winding, each secondary winding is configured to develop a signal of ±2.87 volts.

Figure 8:
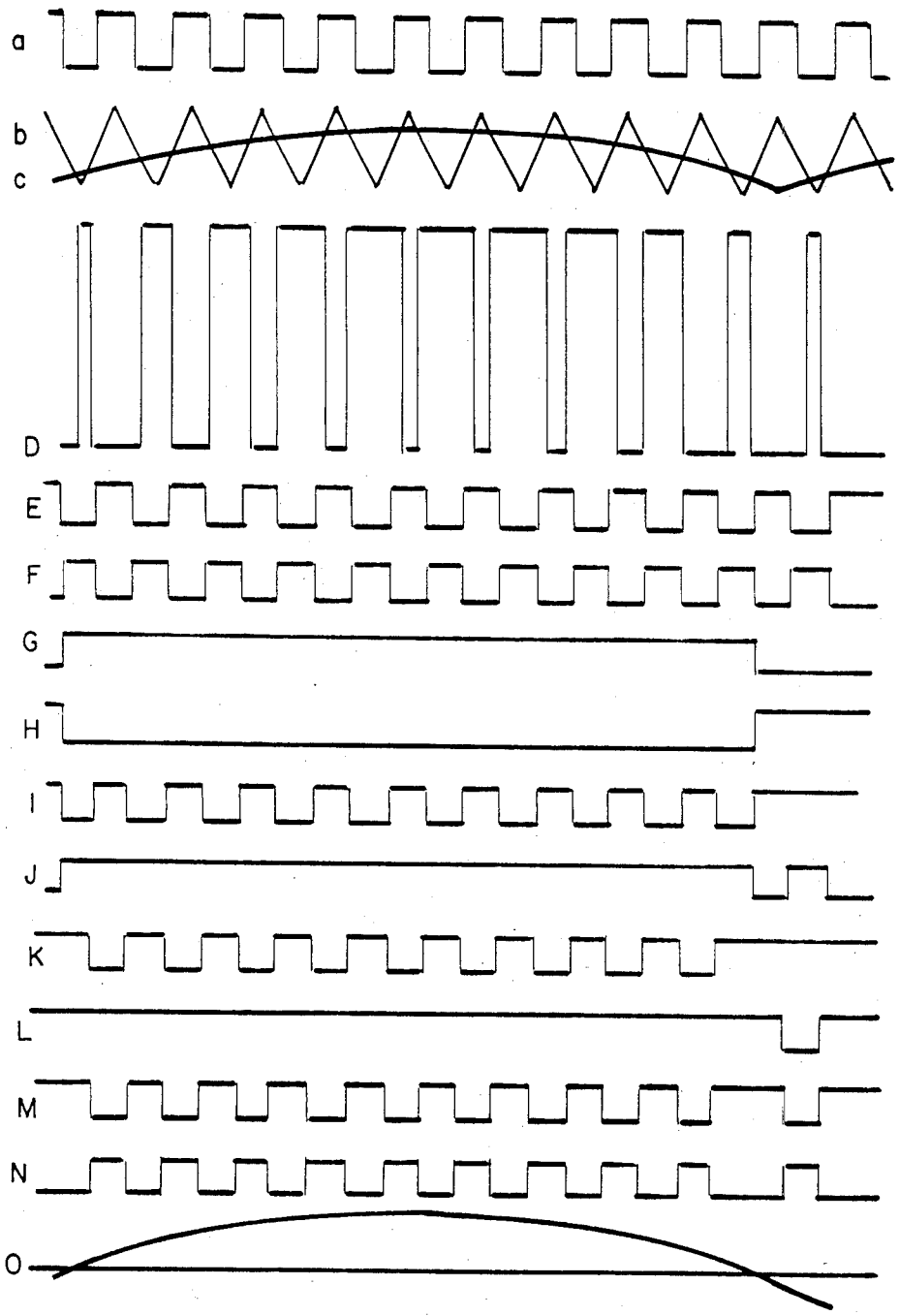
FIG. 8 is a series of signal waveforms representing the signal patterns at various points in the amplifier.

The operation of the circuitry may be better understood by referring to FIG. 8, which shows the signal patterns at various points in the circuitry. Waveform A represents the high frequency square wave generated at the output of the frequency generator circuit 60, while waveform B represents the high frequency triangular shaped signal resulting from the processing of the high frequency square wave signal through the RC circuit R11/C5. This signal, as mentioned previously, rides on a +4 volt offset.

Signal waveform C represents the low frequency, full wave rectified information signal applied to potentiometer P1 in the pulse width modulator circuit. Although the frequencies of signals A and B are shown for purposes of illustration as being only about twenty-two times the frequency of rectified information signal C, in actuality the frequency of the high frequency signals would be approximately 8,000 times that of the low frequency information signal, as described previously.

Signal waveform D represents the pulse width modulated signal which is produced at the output of amplifier A9 and delivered to the switching mode amplifier. A positive pulse is generated during the periods that the amplitude of the low frequency information signal C exceeds the amplitude of the high frequency triangular waveform B; a negative pulse is generated during the periods that the amplitude of waveform B exceeds that of waveform C. The resulting waveform D is a series of pulses, the width of each pulse being proportional to the amplitude of the low frequency information signal prevailing at that time. The pulse modulated signal is processed through switching mode amplifier 40 and emerges on amplifier output line 66 as an amplified signal of the same waveform.

Waveforms E and F represent the high frequency, phase-inverter signals at the outputs of INV2 and INV1, respectively, in the phase reference generator circuit.

Waveform G and H represent the outputs of A5 and A6 in the phase reference generator circuit. Signal G has a logic 1 state and signal H has a logic 0 state for one-half cycle of the low frequency information signal, after which the G and H signals reverse logic states. Waveforms I, J, K and L represent the outputs of NAND1, NAND2, NAND3 and NAND4, respectively. Signals I and K alternate logic states at the high frequency state for one-half cycle of the low frequency signal, the two signal I and K being of opposite logic states during this period. During the intervening low frequency half-cycles, I and K are both in the logic 1 state. Signals J and L are both logic 1 during the low frequency half-cycles that signals I and K alternate logic states, and alternate logic states at the high frequency rate but 180° out of phase with each other during the periods that signals I and K are both logic 1. The result is that the output logic waveforms M and N of A7 and A8, which form the phase reference signals for the demodulator circuit, alternate logic states at the high frequency rate, signals M and N having opposite logic states. After each low frequency half-cycle, signals M and N both shift phase by 180° of the high frequency rate. This produces a similar phase shift in the gating of FET swiches 74, 76, 78 and 80, reversing the polarity of the output amplified information signal as exemplified by waveform 0 in FIG. 8.

The result of the above system is that the input information signal is impedance matched to the transducer load as well as greatly increased in power and transmitted through the earth to the surface without the use of long and relatively low strength toroidal core impedance matching transformers as in the prior art. While numerous variations and alternate embodiments will occur to those skilled in the art, it is intended that the invention be limited only in terms of the appended claims.

We claim:

1. A downhole drillstring signal transmitting system, comprising:

(a) first and second electrically conductive sleeves adapted to form a section of a drillstring, (b) means holding said sleeves in axial alignment with their adjacent ends separated from each other by a predetermined insulative gap, (c) an insulating means separating the sleeve ends across the gap, (d) an amplifier for amplifying a first frequency electrical signal containing downhole information to be transmitted to the surface, the first signal having a frequency which is suitable for effective propagation through the earth from the downhole location to the surface, the amplifier comprising:

(i) input means for receiving the first signal, (ii) a first circuit which is responsive to the first signal for generating a second signal having the downhole information content of the first signal, the frequency of the second signal being at least an order of magnitude greater than the frequency of the first signal, greater than the frequency range for effective propagation through the earth from the downhole location, (iii) means for amplifying the power of the second signal, (iv) an impedance matching means connected to receive the second signal and to provide impedance matching for the amplfier, and (v) a second circuit which is responsive to the impedance matched and amplified second signal for generating a third signal having the downhole information content of the second signal and a frequency which is suitable for effective propagation through the earth from the downhole location, and (e) means for applying the third signal across the sleeves for transmission to the surface.

2. The signal transmitting system of claim 1, said insulating means comprising an anodized aluminum washer.

3. The signal transmitting system of claim 1, said sleeves comprising structural members of the drillstring.

4. The signal transmitting system of claim 1, further comprising an electrically conductive mandrel disposed inside of said electrically conductive sleeves and providing a portion of a signal transmission path between the amplifier and one of the sleeves, and a generally cylindrical and electrically insulative sleeve disposed between the mandrel and the conductive sleeves.

5. The signal transmitting system of claim 4, said electrically insulative sleeve being heat shrunk over said mandrel and in intimate contact therewith, and said conductive sleeves being heat shrunk over said insulative sleeve and in intimate contact therewith.

6. The signal transmitting system of claim 5, said insulative sleeve being formed from anodized aluminum.

7. The signal transmitting system of claim 6, said conductive sleeves being formed of 17-PH-4 stainless steel, and said mandrel being formed of 4140 steel.

8. The signal transmitting system of claim 1, said impedance matching means comprising a transformer which is substantially smaller than the size transformer that would be required for impedance matching between the input and output of the amplifier at the frequency of the first signal, and a low impedance switching circuit for said transformer.

9. The signal transmitting system of claim 8, said switching circuit comprising a plurality of interconnected low on-resistance field effect transistors.

10. The signal transmitting system of claim 9, adapted for a generally sinusoidal first signal, said first circuit comprising means for digitizing the second signal.

11. The signal transmitting system of claim 10, said first circuit further comprising means for pulse width modulating the second signal in accordance with the amplitude of the first signal.

12. The signal transmitting system of claim 11, said second circuit being provided as a demodulator circuit comprising:

first and second circuit means connected respectively between opposed sides of the transformer secondary and the amplifier output, each circuit means including a switch to control the flow of current therethrough, a logic circuit for producing a pair of control outputs, said control outputs being connected to control respective switches of the first and second circuit means, said control outputs being of opposite logic state and alternating at the second signal frequency rate in synchronism with the pulse width modulated signal such that the first and second circuit means apply a rectified signal to the load which is proportional in amplitude to the amplitude of the first signal, said logic circuit further comprising means for shifting the phase of the control outputs by 180° after each first half cycle of the first signal so that a power amplified form of the original first signal is delivered to the transmitting sleeves.

13. The apparatus of claim 12, said logic circuit comprising means for producing first and second logic signals which alternate logic states at the second signal frequency rate and are 180° out of phase with each other, means for producing third and fourth logic signals which alternate logic states at the first signal frequency rate and are 180° out of phase with each other, first, second, third and fourth NAND gates respectively connected to receive the first and third, first and fourth, second and third, second and fourth logic signals, and fifth and sixth NAND gates respectively connected to receive the outputs of the first and second and the third and fourth AND gates, the outputs of the fifth and sixth NAND gates comprising the logic circuit control outputs.

14. Apparatus for transmitting information contained in a first signal from an underground location through a low impedance load such as the earth and a drillstring, the first signal having a frequency which is suitable for effective propagation through the earth from the underground location, comprising:

input means for receiving the first signal, a first circuit which is responsive to the first signal for generating a second signal having the information content of the first signal, the frequency of the second signal being at least an order of magnitude greater than the frequency of the first signal, greater than the frequency range for effective propagation through the earth from the underground location, means for amplifying the power of the second signal, an impedance matching means connected to receive the second signal and to provide impedance matching between the input means and the load, a second circuit which is responsive to the impedance matched and amplified second signal for generating a third signal having the information content of the second signal and a frequency which is suitable for effective propagation through the earth from the underground location, and circuit means for applying the third signal to the low impedance load.

15. The apparatus of claim 14, said impedance matching means comprising a transformer which is substantially smaller than the size transformer that would be required for impedance matching between the input means and the load at the frequency of the first signal, and a low impedance switching circuit for said transformer.

16. The apparatus of claim 15, said switching circuit comprising a plurality of interconnected low on-resistance field effect transistors.

17. The apparatus of claim 15, adapted for a generally sinusoidal first signal, said first circuit comprising means for digitizing the second signal.

18. The apparatus of claim 17, said first circuit further comprising means for pulse width modulating the second signal in accordance with the amplitude of the first signal.

19. The apparatus of claim 18, said second circuit being provided as a demodulator circuit comprising:

first and second circuit means connected respectively between opposed sides of the transformer secondary and the load, each circuit means including a switch to control the flow of current therethrough, a logic circuit for producing a pair of control outputs, said control outputs being connected to control respective switches of the first and second circuit means, said control outputs being of opposite logic state and alternating at the second signal frequency rate in synchronism with the pulse width modulated signal such that the first and second circuit means apply a rectified signal to the load which is proportional in amplitude to the amplitude of the first signal, said logic circuit further comprising means for shifting the phase of the control outputs by 180° after each half cycle of the first signal so that a power amplified form of the first signal is applied to the load.

20. The apparatus of claim 19, said logic circuit comprising means for producing first and second logic signals which alternate logic states at the second signal frequency rate and are 180° out of phase with each other, means for producing third and fourth logic signals which alternate logic states at the first signal frequency rate and are 180° out of phase with each other, first, second, third and fourth NAND gates respectively connected to receive the first and third, first and fourth, second and third, and second and fourth logic signals, and fifth and sixth NAND gates respectively connected to receive the outputs of the first and second and the third and fourth NAND gates, the outputs of the fifth and sixth NAND gates comprising the logic circuit control outputs.

21. A method of transmitting information contained in a first signal through the earth from an underground location, the first signal having a frequency which is at least an order or magnitude greater than the frequency of the first signal, suitable for effective propagation through the earth, comprising the steps of:

generating a second signal in response to the first signal, the second signal retaining the information content of the first signal, the frequency of the second signal being greater than the frequency range for effective propagation through the earth from the underground location, amplifying the power of the second signal, processing the second signal through an impedance matching means, generating a third signal in response to the processed and amplified second signal, the third signal having a frequency which is suitable for effective propagation through the earth from the underground location, and transmitting the third signal through the earth.

22. The method of claim 21, wherein the second signal is processed through an impedance matching transformer which is substantially smaller than the size transformer than would be required for impedance matching at the frequency of the first signal.

23. The method of claim 22, wherein the first signal is generally sinusoidal and is converted to a digitized signal at the second signal frequency prior to amplification.

24. The method claim 23, wherein the digitized signal is pulse width modulated in accordance with the amplitude of the first signal.

25. The method of claim 24, wherein the processed and amplified pulse width modulated signal is converted to the third signal format by providing a pair of signal paths between the output of the impedance matching transformer and the load, controlling the signal paths so that one path is conductive while the other path is non-conductive, alternating the conductivity of the signal paths at the second signal frequency rate in synchronism with

26. The method of claim 22, wherein the amplified signal is applied across an electrically insulative gap.

27. The signal transmitting system of claim 1, wherein the frequency of the first signal is substantially equal to the frequency of the third signal.

28. The apparatus of claim 14, wherein the frequency of the first signal is substantially equal to the frequency of the third signal.

29. The method of claim 21, wherein the frequency of the first signal is substantially equal to the frequency of the third signal.

30. A downhole drillstring transducer for inducing earth currents in response to an applied electrical signal having a frequency which is suitable for effective propagation through the earth from a downhole location, comprising:

an electrically conductive mandrel, an electrically insulative inner sleeve heat shrunk over the mandrel and in intimate contact with the exterior of the mandrel, the inner sleeve being formed from a substantially rigid material, first and second outer sleeves formed from a substantially rigid conductive material, the outer sleeves being heat shrunk over the inner sleeve and in intimate contact with the exterior thereof, the adjacent ends of the outer sleeves being separated from each other by a predetermined gap the dimensions of which are selected to induce an earth current in response to the electrical signal being applied across the gap, the outer sleeves being electrically isolated from the mandrel by the inner sleeve, an insulating material disposed in the gap and insulating the adjacent ends of the outer sleeves from each other, and means electrically connecting the mandrel with one of the outer sleeves, said mandrel providing a transmission path for delivering an earth current-inducing signal to said one outer sleeve through said connecting means.

31. The transducer of claim 30, said insulating material comprising a substantially rigid washer heat shrunk over the insulative sleeve.

32. The transducer of claim 31, said washer being formed from anodized aluminum.

33. The transducer of claim 30, said sleeves comprising structural members of a drillstring.

34. The transducer of claim 30, said insulative sleeve being formed from anodized aluminum.

35. The transducer of claim 34, said conductive sleeves being formed of 17-PH-4 stainless steel, and said mandrel being formed of 4140 steel.

* * * * *